US005951262A

United States Patent [19]

Hartman

[11] Patent Number: 5,951,262

[45] Date of Patent: Sep. 14, 1999

[54] MECHANISM FOR PROVIDING MOTIVE FORCE AND FOR PUMPING APPLICATIONS

[75] Inventor: Michael G. Hartman, Kent, Wash.

[73] Assignee: Centriflow LLC, Kirkland, Wash.

[21] Appl. No.: 08/844,576

[22] Filed: Apr. 18, 1997

[51] Int. Cl.[6] ..... F04B 35/04

[52] U.S. Cl. ..... 417/356; 417/423.5

[58] Field of Search ..... 417/355, 356, 417/423.3, 423.5

[56] References Cited

U.S. PATENT DOCUMENTS

| | | | |
|---|---|---|---|
| 242,400 | 5/1881 | Voelker | 417/356 |
| 534,428 | 2/1895 | Dean | 415/73 |
| 562,480 | 6/1896 | McMurrin . | |
| 815,302 | 3/1906 | Marvin | 415/73 |
| 979,041 | 12/1910 | Smith | 415/75 |
| 1,459,453 | 7/1923 | Trigwell . | |
| 1,816,971 | 8/1931 | Hoff et al. . | |
| 2,500,400 | 3/1950 | Cogswell | 417/355 |
| 2,697,986 | 12/1954 | Meagher, Jr. | 417/356 |
| 2,747,512 | 5/1956 | Fouche | 103/87 |
| 3,972,653 | 8/1976 | Travis et al. | 417/356 |
| 4,145,383 | 3/1979 | Randall | 261/29 |
| 4,170,436 | 10/1979 | Candler | 415/73 |
| 4,500,254 | 2/1985 | Rozniecki | 415/75 |
| 4,957,504 | 9/1990 | Chardack | 623/3 |
| 5,017,087 | 5/1991 | Sneddon | 415/72 |
| 5,088,899 | 2/1992 | Blecker et al. | 417/356 |
| 5,205,721 | 4/1993 | Isaacson | 417/356 |
| 5,209,650 | 5/1993 | Lemieux | 517/356 |
| 5,290,227 | 3/1994 | Pasque | 600/16 |
| 5,336,070 | 8/1994 | Fujiwara et al. | 418/220 |
| 5,366,341 | 11/1994 | Marino | 415/6 |
| 5,484,266 | 1/1996 | Murga | 417/355 |
| 5,505,594 | 4/1996 | Sheehan | 417/420 |
| 5,527,159 | 6/1996 | Bozeman, Jr et al. | 417/45 |

FOREIGN PATENT DOCUMENTS

| | | | |
|---|---|---|---|
| 452538 | 10/1991 | European Pat. Off. | 417/355 |

*Primary Examiner*—Charles G. Freay
*Attorney, Agent, or Firm*—Zackery, Furrer & Tezak

[57] ABSTRACT

Provided in accordance with the principles of the present invention, in one preferred embodiment, is a mechanism (10). The mechanism functions in general for providing motive force, and is specially adapted for pumping applications. In particular, the mechanism includes an impeller/pumping section integral with a drive system (16). The mechanism includes a housing (14), and a tube (18) rotatably mounted within the housing. Specifically, the tube mounts in the housing for rotation of the tube relative to the housing, substantially about the tube's longitudinal axis. A power or drive system (16) connected to the tube, and/or forming part of the tube, causes the tube to rotate relative to the housing. The drive system preferably includes a plurality of magnets (42) mounted within the housing, located around the tube, for creating magnetic forces for causing the tube to rotate. One or more impellers (20) mount to the tube. The impellers are adapted to cause fluid flow through the tube when the tube rotates. Tube rotation via the drive system, thus causes fluid flow through the tube.

25 Claims, 4 Drawing Sheets

MECHANISM FOR PROVIDING MOTIVE FORCE AND FOR PUMPING APPLICATIONS

FIELD OF THE INVENTION

The present invention relates to motors, and in particular, to pumping systems.

BACKGROUND OF THE INVENTION

Pumps have been important to human civilization since virtually the dawn of recorded history. People have almost always had some need to transport a fluid from one location to another. Humans probably invented the first pump in connection with the need for irrigating crops, and/or for supplying a settlement with water. Since that time, people have applied pumps to meet other fluid transportation needs, such as removing oil from wells, circulating refrigerant through cooling systems, pressurizing air for use in pneumatic systems, which are just a few examples of the many applications for pumps.

A problem common to all pumps has been maximizing the fluid flow rate through a pump for a given size/weight of pump, i.e., maximizing pumping efficiency. For urging a fluid in a particular direction, most pumps employ one of two systems: (i) positive displacement, or (ii) or centrifugal action. In either system, the result is to urge fluid to flow in a particular direction.

These systems of course require a motor, i.e., some mechanism for supplying the motive force for either causing positive displacement or centrifugal action in the pump. In all such systems presently known to the inventor, a non-integral motor has been used to supply the motive force. Specifically, a motor connects through a shaft, gearing, roller, or other mechanical arrangement, and supplies the motive force for either causing positive displacement or centrifugal action within a pump.

While satisfactory for many applications, the mechanical arrangement coupling the pump motor to the fluid flow mechanism in a pumping system necessarily introduces costs and inefficiencies. For instance, all coupling mechanisms are costly, are susceptible to breakdown, take up space, add weight to the pumping system, and cause frictional losses.

The present invention provides an improved arrangement.

SUMMARY OF THE INVENTION

A mechanism, provided in accordance with the principles of the present invention, in a preferred embodiment, functions in general for providing motive force. Additionally, the mechanism is specially adapted for pumping applications, having an impeller/pumping section integral with a drive system. The integral arrangement improves efficiency, as it avoids the losses inherent in prior pumping systems that have essentially separate motor and pumping sections. Further, the integral arrangement results in substantial fluid flow through the drive system, resulting in greater cooling for the drive system, when using the mechanism in motor applications, i.e., for providing motive force for another device.

The mechanism includes a housing, and a tube rotatably mounted within the housing. Specifically, the tube mounts in the housing for rotation of the tube relative to the housing, substantially about the tube's longitudinal axis. A power or drive system acts upon the tube, causing the tube to rotate relative to the housing.

The drive system includes a plurality of magnets mounted within the housing, located around the tube, for creating magnetic forces for causing the tube to rotate. More particularly, magnets preferably mount to both the tube and the housing. The magnets create interacting magnetic forces, as in a conventional electric motor, for causing rotation of the tube. In alternative embodiments, the tube may not necessarily include magnets, and be driven via induction from magnets mounted in the housing, as in a conventional induction electric motor.

One or more impellers mount to the tube. The impellers are adapted to cause fluid flow through the tube when the tube rotates. Thus, tube rotation via the drive system, causes fluid flow through the tube. Fluid enters the housing through an inlet at one end of the housing, and discharges through an outlet at the other end of the housing.

In one preferred embodiment, at least one end of the tube extends through the housing exterior wall, for connection of the tube end to another device. More particularly, the tube connects to the other device, for providing rotational mechanical energy to the other device. That is, for functioning as a motor for the other device.

In another preferred embodiment, a shaft supports the tube. In this arrangement, the housing rotatably supports the shaft for permitting rotation of the tube. At least one shaft end extends beyond the exterior of the housing to connect to another device for functioning as a motor for that device.

The present invention thus provides mechanisms that function in general for providing motive force, and in particular, for pumping applications.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

Figure 3:
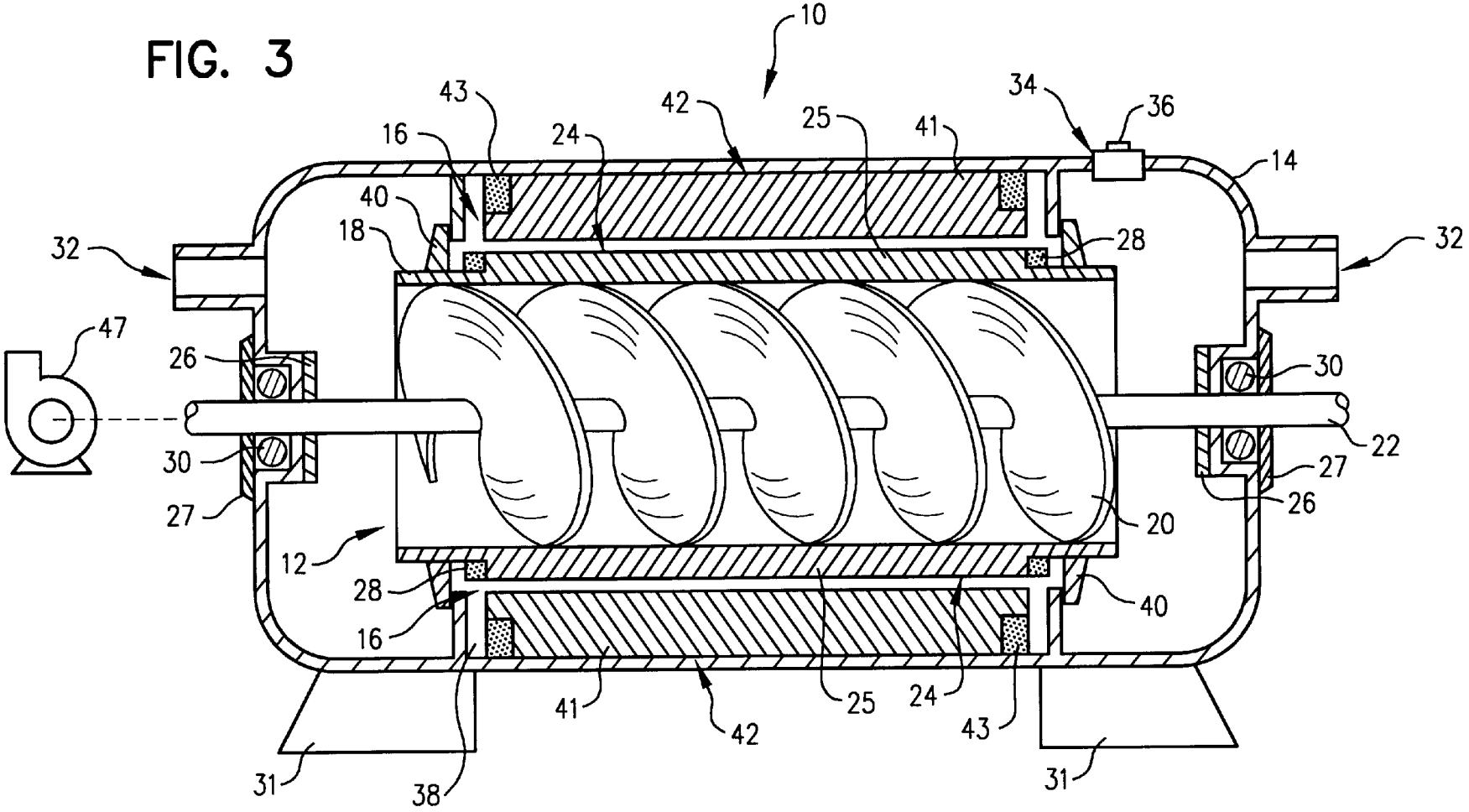
FIG. 3 illustrates a cross-sectional view through a mechanism in accordance with the present invention, incorporating the tube system of FIG. 1, with part of the tube system illustrated via a perspective view.

FIG. 3 illustrates a preferred embodiment of a mechanism 10 in accordance with the present invention. The mechanism 10 functions in general for providing motive force, and is particularly adapted for pumping applications. The major components of the mechanism 10 include: (i) a cylinder or tube system 12; (ii) a housing 14 substantially surrounding or enclosing the tube system; and (iii) a power or drive system 16.

Figure 1:
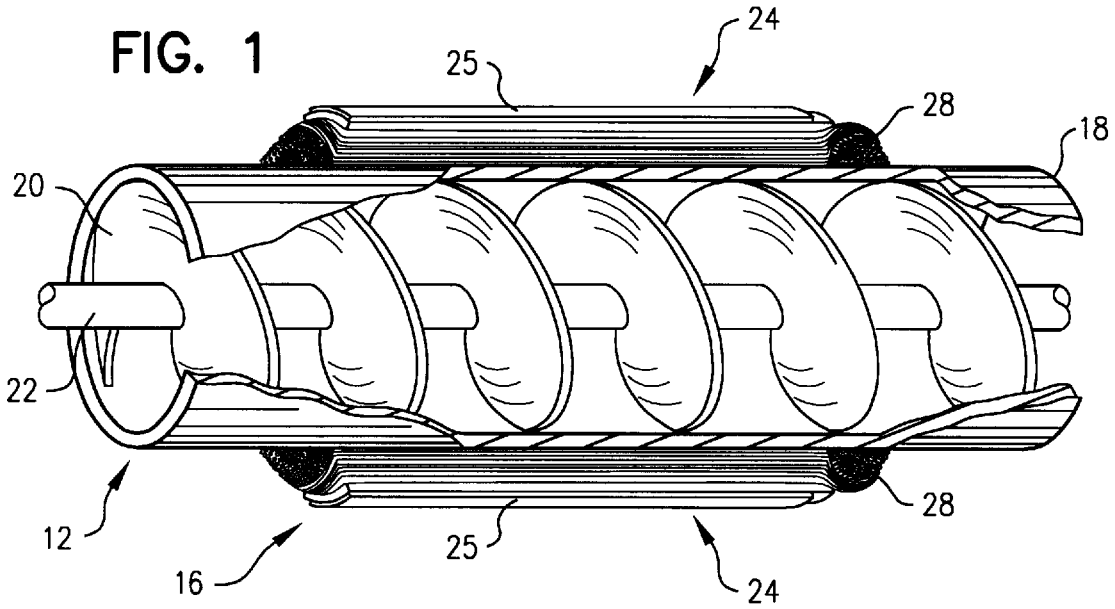
FIG. 1 illustrates a perspective, partial cut-away view of a preferred embodiment of a portion of a tube system in accordance with the present invention.

FIG. 1 illustrates a view of the tube system 12, shown removed from the housing 14. The tube system 12 includes a cylinder or tube 18 having impellers 20 running internally along the length of the tube 18. A support shaft 22 extends through the tube 18, substantially along the tube's longitudinal axis. The impellers 14 mount to the tube 18 and the shaft 22, extending from the shaft to the tube's inner surface, spiraling along the tube's length in a screw conveyor arrangement. When the tube 18 rotates about its longitudinal axis (and the impellers 20 rotate along with the tube), the impellers act to urge fluid to flow through the tube.

The view shown in FIG. 1 additionally illustrates part of the drive system 16 for causing rotation of the tube 18 about its longitudinal axis. The drive system 16 includes a plurality of magnets 24, mounted to the outer circumference of the tube 18. The magnets 24 are preferably conventional electromagnets, having a core 25, and wiring 28. The magnets 24 are spaced around the outer circumference of the tube 18 at approximately regular intervals as in the arrangement for the electromagnets typically used in the armature for conventional electric motors. A commutator or slip rings (not shown) mount around the outer circumference of the tube 10 for supplying the magnets 24 with electrical power as the tube 18 rotates. The commutator/slip ring arrangement connects to the wiring 28 for the magnets 24, as typically used in a commutator/slip ring arrangement for supplying electrical power to the armature of a conventional electric motor.

Referring to FIG. 3, the tube system 12 rotatably mounts within the housing 14. Conventional bearings 30 at each end of the housing 14 rotatably support the shaft 22. The ends of the shaft 22 extend through the housing exterior wall, and through the bearings 30, which rotatably support the shaft. Each end of the shaft 22 additionally extends through an interior annular seal 26, opposite each bearing 30, within the housing 14. The seals 26 surround the shaft's outer circumference, for forming a seal around the shaft 22. When the shaft 22 rotates, the seals 26 slide around the shaft's exterior, and maintain sealing contact around the shaft circumference, for substantially preventing fluid in the housing 14 from escaping between the housing/shaft interface, and protecting the bearing 30. The ends of the shaft 22 similarly extend through an external annular seal 27 on the opposite side of each bearing 30.

Feet or mounting bases 31 extend from the lower surface of the housing 14. The mounting bases 31 support the mechanism 10 above a surface.

Each end of the housing 14 defines an opening 32 for permitting the mechanism 10 to function as a pump. As discussed earlier, when the tube 18 rotates, and the impellers 20 rotate along with the tube, the rotating impellers urge fluid to flow through the tube. One of the openings 32 functions as an inlet for receiving fluid into the housing 14 and into the tube 18. The other opening 32 functions as an outlet for receiving fluid from the tube 18, and discharging the fluid from the housing 14. The top of the housing 14 additionally includes an opening 34, sealed with a removable plug 36. This opening 34 permits priming of the mechanism 10, wherein the pumping fluid is a liquid. That is, the opening 34 permits filling the interior of the housing 14 with an initial supply of fluid sufficient to initiate pumping of the fluid.

The interior of the housing 14 includes a centrally disposed cylindrical or tubular recess 38. The tubular recess 38 coaxially surrounds the portion of the tube 18 to which magnets 24 mount, and encloses this portion of the tube. In particular, a collar or large annular seal 40 caps each end of the tubular recess 38.

Each end of the tube 18 centrally extends through the annular seal 40, in a sliding fit with the seal's inner circumference, to seal the ends of the tubular recess 38. When the tube 18 rotates, the inner circumference of the seal 40 slides around the tube's exterior, and maintains sealing contact around the tube's exterior. When pumping a liquid fluid, the annular seal 40 thus substantially prevents fluid pumped through the housing 14 and tube 18, from contacting electrical components of the drive system 16.

Stationary magnets 42 mount within the tubular recess 38, around the tube 18. The stationary magnets 42 also form part of the drive system 16, and are preferably conventional electromagnets, having wiring 43 and a core 41. The stationary magnets 42 mount at approximately regular, circumferential intervals around the tubular recess 38. In operation, the stationary magnets 42 and the tube magnets 24 create interacting magnetic forces that cause the tube 18 to rotate. In particular, the stationary magnets 42 mount in close proximity to the tube magnets 24, as in the arrangement for a conventional electrical motor having stationary magnets mounted in close proximity to magnets mounted on the motor's armature.

As discussed above, the magnets 24 and 42 in the mechanism 10 create interacting magnetic forces, as in a conventional electric motor, and cause the tube 18 to rotate. The impellers 20, rotating with the tube 18, cause fluid flow through the tube. The mechanism 10 thus functions as an integral motor and pump system, drawing fluid in one opening 32, and discharging fluid through the other opening.

Most prior pumps, as mentioned in the background for the present invention, employ one of two systems for causing fluid flow: (i) positive displacement, or (ii) centrifugal action. These systems require a motor for supplying the motive force for either causing positive displacement action, or centrifugal action. In all such systems presently known to the inventor, a non-integral motor supplies the motive force. Specifically, a motor couples through a shaft, gearing, roller, or other mechanical arrangement, and supplies the motive force to either cause rotation and/or positive displacement action of mechanical components within a pump. The coupling mechanism necessarily introduces costs and inefficiencies. Namely, all coupling mechanisms are costly, are susceptible to breakdown, take up space, add weight to the pumping system, and cause frictional losses.

The present mechanism 10 substantially avoids these disadvantages by providing an integral motor and pump system. That is, the mechanism 10 eliminates the coupling arrangement used in prior pumping systems, and is therefore less costly and more efficient.

Another advantage of the present mechanism 10, is that it may be used for driving other devices, i.e., the mechanism 10 can function as a motor. In this regard, the ends of the shaft 22 project through the exterior of the housing 14 for connection to another device. Specifically, the shaft ends may be mechanically coupled to other devices for providing motive force, i.e., acting as a motor for other devices.

For example, the ends of the shaft 22 may be connected to a conventional pump 47 and function as the pump motor. In this arrangement, the present mechanism 10 may also be "staged" with the pump. That is, the output from the pump can be input into the mechanism 10, or vice versa, so that the mechanism and pump combine to produce a higher volume and/or pressure of fluid flow, than either would produce individually.

When functioning as a motor for another device, the mechanism 10 has fluid flowing centrally through the drive system 16 due to the rotating impellers 20 in the tube 18. This fluid flow results in improved cooling, relative to prior types of electric motors. Applications are contemplated for the mechanism 10 as a motor, where cooling to prevent motor overheating is a significant concern.

Mechanisms in accordance with the present invention may employ any suitable type of impeller arrangement for urging fluid flow. Impeller arrangements may be optimized for the type of fluid (e.g., certain impeller arrangements for air or other gases, as opposed to a liquid, or perhaps for highly viscous fluids), desired pumping volume, pressure, and/or other parameters. In particular, FIG. 6 illustrates another preferred embodiment of a mechanism 44 in accordance with the present invention, having a different impeller arrangement.

Figure 6:
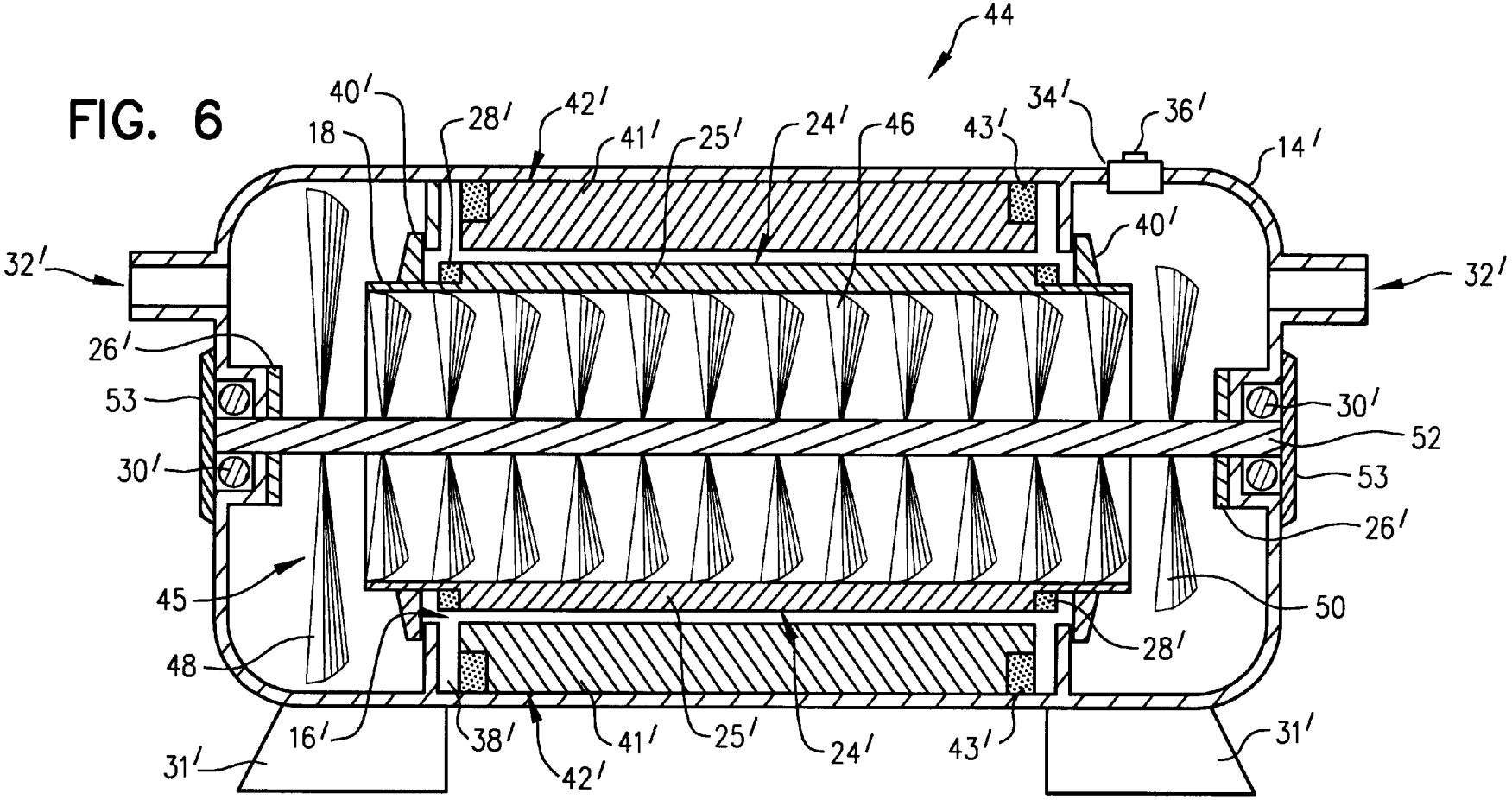
FIG. 6 illustrates another preferred embodiment of a mechanism in accordance with the present invention.

The mechanism 44 shown in FIG. 6 employs several components substantially identical to those for the previously described embodiment. Identical reference numerals are used for the embodiment of FIG. 6, and the previously described embodiment, to indicate substantially identical, corresponding components, with the prime symbol (') following reference numerals for the embodiment of FIG. 6.

The primary external difference in the mechanism 44 of FIG. 6, compared to the previous embodiment, is that the mechanism does not have the ends of a shaft projecting from the device. In this regard, the mechanism 44 of FIG. 6 has not been designed for powering another device, such as a conventional pump (although the mechanism could be modified to do so as discussed in the following paragraphs).

In other aspects, externally, the mechanism 44 generally appears similar to the previously described embodiment. More particularly, the mechanism employs a housing 14' substantially identical to the housing of the previous embodiment. Briefly, mounting bases 31' extend from the housing's lower side for supporting the mechanism 44 above a surface. An opening 32' in each end of the housing 14' permits the mechanism 44 to function as a pump. Specifically, one opening 32' serves as a pump inlet, and the other opening serves as the pump outlet. An opening 34' in the top of the housing 14', sealed with a removable plug 36', permits priming of the mechanism 44 (where the pumping fluid is a liquid). A tubular recess 38' in the housing 14', capped at each end with a large annular seal 40', substantially encloses the drive system 16' for the mechanism 44.

Internally, the mechanism 44 employs a different tube system 45. The tube system 45 employs a tube 18' substantially identical to the tube in the previous embodiment, but has an altered impeller arrangement. Specifically the impellers 46, 48 and 50 are in the form of spaced apart vanes or blades.

The impellers 46, 48 and 50 radiate from a shaft 52. The shaft 52 extends through the tube 18, substantially along the tube's longitudinal axis. Bearings 30' at each end of the housing 14' rotatably support the shaft 52. In particular, the ends of the shaft 52 extend through the housing exterior wall, and into the bearings 30'. Each end of the shaft 52 additionally extends through an interior annular seal 26', opposite each bearing 30', substantially identical to the interior annular seals of the previous embodiment. A cap seal 53 opposite the side of each bearing 30' adjacent the housing 14', seals the bearings and shaft 52 from the exterior environment. (In alternate embodiments, one or both of the cap seals 53 could be replaced with an annular seal, and the shaft 52 with one having a longer length; there would thus be a projecting shaft end or ends as in the previous embodiment for driving another device, i.e., for functioning as a motor).

Preferably, the impellers 46, 48 and 50 each radiate in assemblages at spaced apart locations along the shaft 52. Each impeller in a group 46, 48 or 50, extends outward at spaced apart positions around the shaft's circumference, at the location for that assemblage.

A first set of impellers 46 run internally along the length of the tube 18', extending from the shaft 52 to the tube's inner surface. Larger impellers 48 or 50 extend from the shaft 52, forward and aft of the ends of the tube 18'. The larger impellers 48 and 50, being external to the tube 18', can thus extend for a distance greater than the tube's diameter. Depending, on fluid flow considerations, the larger impellers 48 and 50 may extend for the same, or different lengths, for achieving greater pumping efficiency in the mechanism 44. As illustrated, the larger impellers 48 proximate one end of the tube 18', extend for a greater distance than the impellers 50 proximate the other tube end.

The mechanism 44' includes a drive system 16' substantially identical to the drive system for the previous embodiment. Briefly, the drive system 16' includes a plurality of magnets 24' mounted to the outer circumference of the tube 18'. The magnets 24' are preferably conventional electromagnets, having wiring 28', a core 25', and a commutator/slip ring arrangement for supplying the magnets with electrical power when the tube 18' rotates. Stationary magnets 42' mount within the tubular recess 38', around the tube 18'. The stationary magnets 42' are also preferably electromagnets, having wiring 43', and a core 41'. In operation, the stationary magnets 42' and the tube magnets 24' create interacting magnetic forces that cause the tube 18' to rotate. In particular, the stationary magnets 42' mount in close proximity to the tube magnets 24', as in the arrangement for a conventional electrical motor having stationary magnets mounted in close proximity to magnets on the motor's armature.

Generally, larger bearings (and seals for protecting the bearings) are more costly. The previously described embodiments employ a shaft for supporting the tube in the mechanism 10 or 44. This arrangement permits the use of smaller bearings. That is, due to the smaller diameter of the shaft, relative to the tube, smaller bearings can be used for rotatable shaft support.

Figure 2:
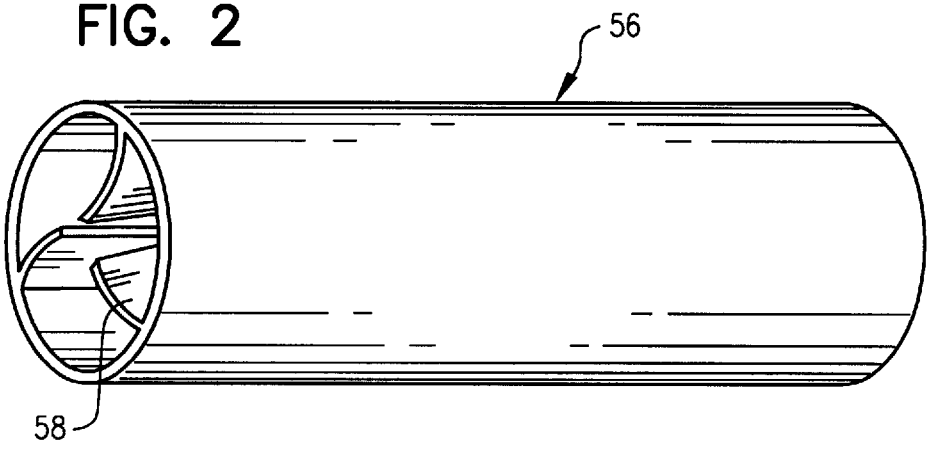
FIG. 2 illustrates another preferred embodiment of a tube in accordance with the present invention, for use in place of the tube in the system of FIG. 1.

In some applications, it may be desirable to employ larger bearings (and larger bearing seals), despite increased costs, for example, in applications requiring maximum pumping efficiency. More particularly, the shaft in the previous embodiments takes up space, and for this reason, arguably decreases the fluid pumping rate through the mechanisms 10 and 44. FIG. 2 illustrates a tube 56 for use in alternate embodiments of these mechanisms, that do not have a shaft.

Specifically, the tube 56 has impellers 58 that do not require support from a central shaft. Instead, the impellers 58 cantilever inward from around the inner circumference of the tube 56. Each impeller 58 forms a curved blade, angling along the tube's length.

The tube 56 may be used to replace tubes 18 in the previous embodiments, with some modifications. In the modified mechanisms, the ends of the housing 14 or 14' are preferably removed to expose the ends of the tube 56 to the environment. Hence, the ends of the tube 56 effectively serve as the input and output in the modified mechanisms. Further, the tubular recess 38 or 38' in the housing 14 or 14' includes a pair of large annular seals 40 or 40' at each end, rather than a single seal. Additionally, the housing 14 or 14' includes a large bearing disposed between each pair of annular seals 40 or 40' at each end of the tubular recess 38 or 38'. The bearing receives and rotatably supports each end of the tube 56, while the seals 40 or 40', protect the bearing and drive system.

Figure 4:
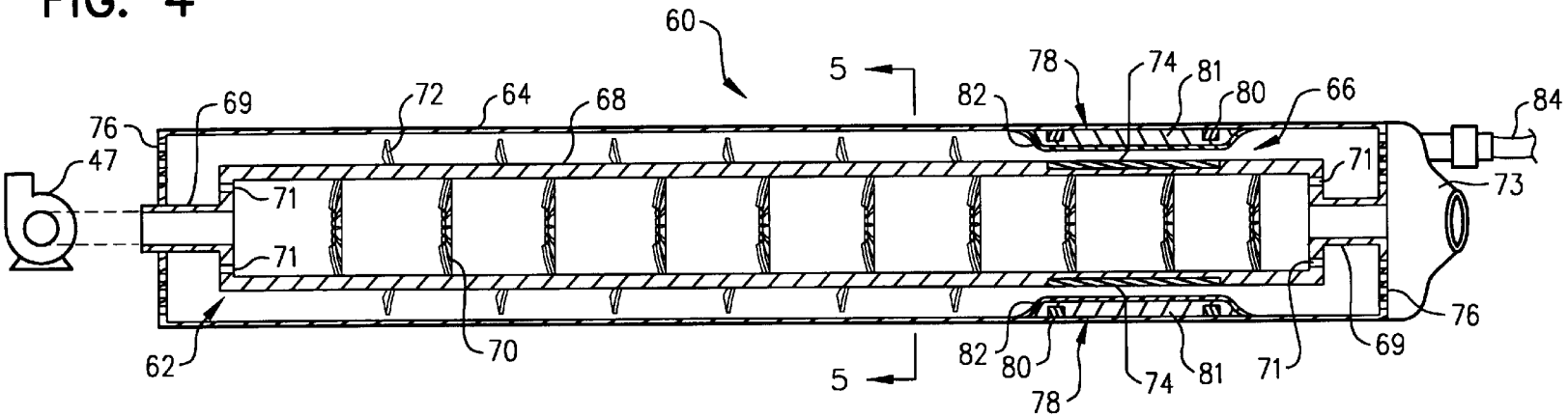
FIG. 4 illustrates a partial cross-sectional view of another preferred embodiment of a mechanism in accordance with the present invention.

FIG. 4 illustrates another preferred embodiment of a mechanism 60 in accordance with the present invention. As discussed in the following paragraphs, the mechanism 60 is specially adapted for submersible well pump applications. The major components of the mechanism 60 include: (i) a cylinder or tube system 62; (ii) a housing 64 substantially surrounding or enclosing the tube system; and (iii) a power or drive system 66.

The tube system 62 includes a cylinder or tube 68, having a narrower diameter portion or neck 69, projecting from each end of the tube. Each neck 69 extends substantially coaxially from its respective end of the tube 68. The necks 69 are hollow, such that there is path of fluid communication through each neck to the interior of the tube's main body portion. Hence, there is a path of fluid communication defined completely through the tube 68.

As illustrated, there is an abrupt shoulder at the interface between each neck 69 and the tube's main body portion (the shoulder may include rounding or smoothing of abrupt corners for improved fluid flow efficiency through the mechanism 60 in alternative embodiments). The portion of each shoulder facing along the tube's longitudinal axis includes holes 71, extending through to the interior of the tube's main body portion. The holes 71 thus define paths of fluid communication through each shoulder, from the exterior environment to the interior of the tube's main body portion.

Figure 5:
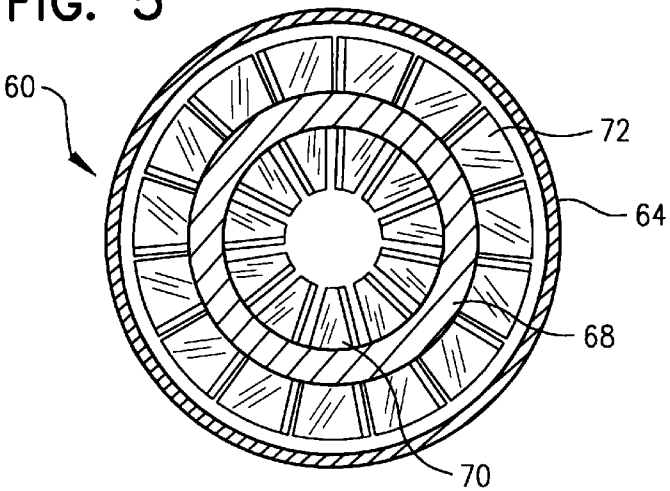
FIG. 5 illustrates a cross-sectional view of the mechanism of FIG. 4, taking along section line 5—5 in FIG. 4.

Internal and external impellers 70 and 72 mount to the main body portion in the tube 68. FIG. 5 illustrates a view of the impellers 70 and 72, along the longitudinal axis of the tube 68. As illustrated, the impellers 70 or 72 are in the form of vanes or blades. When the tube 68 rotates, and the impellers 70 and 72 with the tube, the impellers urge fluid to flow along the tube. The internal impellers 70 cause fluid flow internally through the tube 68, and the external impellers 72 cause fluid flow along the exterior of the tube.

The impellers 70 or 72 preferably mount in either internal or external assemblages at spaced apart locations along the tube's length. Each impeller 70 in an internal assemblage, radiates inward at spaced apart positions around the inner circumference of the tube 68, at the location for that assemblage. Conversely, each impeller 72 in an external assemblage, radiates outward at spaced apart locations around the outer circumference of the tube 68, at the location for that assemblage.

The tube system 62 additionally includes part of the drive system 66 for causing rotation of the tube 68 about its longitudinal axis. Specifically, magnets 74 mount to the main body portion of the tube 68. The magnets 74 mount around a section of the outer circumference of the tube 68, preferably proximate to one end of the tube's main body portion.

The magnets 74 are preferably permanent magnets, of the type used in many kinds of conventional electric motors. The magnets 74 are arranged at approximately regular intervals around the tube's circumference as in the arrangement for conventional electrical motors of the type employing permanent magnets on the motor's armature. For increased fluid flow efficiency through the mechanism 60, the magnets 74 are preferably recessed in the tube's outer surface, with the outer surface of each magnet flush with the tube's outer surface.

The tube system 62 rotatably mounts within the housing 64. In this regard, the housing 64 generally forms a cylinder or tube shape, substantially surrounding, or enclosing, the tube system 62. The tube system 62 mounts substantially coaxially within the housing 64. In particular, the housing 64 has an internal diameter sufficiently large to accommodate rotation of the tube 68 (and of the external impellers 72 extending from the tube) about the tube's longitudinal axis, without interference.

Bearings (not shown) at either end of the housing 64, receive the necks 69 extending from either end of the tube 68 for permitting tube rotation. The bearings are preferably a commercially available type in which captive fluid or fluid being pumped supplies all necessary lubrication (conventional submersible well pumps typically employ these types of bearings). Hence, the bearings do not have to be "sandwiched" between seals in this embodiment.

The necks 69 thus function as shafts in the bearings for rotatably supporting the tube system 62 (the narrower necks 69, relative to tube's main body portion, permit the use of less costly, smaller bearings). In this mounting arrangement, the ends of the necks 69 are exposed to the environment through the ends of the housing 68.

Additionally, the housing ends include many small perforations, or a grid 76, such that the housing interior is in fluid communication with the environment, through each end of the housing 64. When the tube 68 rotates, the impellers 70 and 72 draw fluid into the housing 64 through the grid 76 in one housing end, and discharge the fluid through the grid in the opposite housing end. The impellers 70 and 72 further cause fluid flow directly through the tube 68, via the necks 69.

The internal impellers 70 are mainly for causing fluid flow directly through the tube 68 via the necks 69. Conversely, the external impellers 72 are mainly for causing fluid flow along the exterior of the tube 68 via the grid in the housing ends. That is, the external impellers 72 are mainly for causing fluid flow through the mechanism 60 in the space between the exterior of the tube 68, and the internal surface of the housing 64. However, there can be fluid flow within the housing 64, from the interior of the tube 68, to the tube exterior, and vice versa, through the holes 71 in the shoulders of the tube, and/or other holes along the sides of the tube in alternative embodiments.

One or more ends of the housing 64, may include a nozzle 73 for directing fluid flow in a particular direction. The nozzle 73 generally corresponds in shape to a funnel. The large diameter end of the nozzle's funnel-shape mates to an end of the housing 64.

The narrower diameter end of the funnel-shape may connect to piping or other fluid conduit for directing fluid into, or directing fluid from, the housing 64. The nozzle 73 also functions for protecting its respective end of the housing 64.

The drive system 66 includes stationary magnets 78 mounted in the interior of the housing 64, around the tube 68. The stationary magnets 78 are preferably conventional electromagnets, having wiring 80, and a core 81, mounted at approximately regular intervals around a circumferential housing section. Specifically, the stationary magnets 78 mount to a section of the housing interior, opposite the magnets 74 on the tube 68. In operation, the stationary magnets 78 and tube magnets 74 create interacting magnetic fields that cause the tube 68 to rotate.

Each stationary magnet 78 is preferably embedded, or sealed, in a plastic material 82. The plastic material 82 protects the stationary magnets 78 from fluid flowing through the mechanism 64 for preventing electrical shorts, when the pumping fluid is conductive, and also functions to prevent corrosion. As illustrated, the plastic material may be molded to round or smooth abrupt corners for improved fluid flow efficiency through the mechanism 60. Insulated wiring (not shown) extends through the plastic material 82, along the housing wall, for supplying each stationary magnet 78 with electrical power via wiring 84 from an external power source.

As the magnets 74 on the tube 68 are permanent magnets, these magnets do not require a source of electrical power for generating a magnetic field. The tube magnets 74 thus have an advantage in that they do not require protection from fluid contact for preventing electrical shorts, when the pumping fluid is conductive, and also functions for preventing corrosion. The disadvantage, though, is that generally, not as much torque will be available with arrangements employing permanent magnets, relative to comparable arrangements employing only electromagnets.

In alternative embodiments, however, the permanent magnets 74 may be replaced with an inductive system, as in conventional induction electrical motors. In an induction electrical motor, stationary electromagnets act on core elements, and/or electromagnets, mounted on, or within, the motor's armature or rotor, which operate via induced current flow. The result is magnetic forces interacting with the rotor, and causing rotation of the rotor. As there is no direct electrical power supply to the rotor, i.e., electrical power to the rotor is supplied only via induction, there is no need for brushes for supplying electrical power to the rotor.

A similar induction system may accordingly be incorporated into the mechanism 60, as with a conventional induction electrical motor. Since electrical power would be supplied only via induction to the tube, and not through brushes, drive system components on the tube 68 could thus be sealed in plastic or other sealing material for protection against fluid contact. (In alternative embodiments, permanent magnets or inductive arrangements could also be used in the previously mechanisms 10 and 44).

For pumping applications, the mechanism 60 provides advantages over prior pumping systems, especially in submersible well pumping applications. Most prior submersible pumping systems for use in a well, employ a series of rotating impellers. The impellers coaxially mount in a housing. An electrical motor mounts to the bottom of the housing, and causes rotation of the impellers through a shaft. In use, such prior submersible pumping systems are placed into a well, via the well casing. In the well, fluid enters the housing at entrances between the motor and the section that houses the impellers. Operation of the motor then causes the impellers to pump fluid to the surface, through plumbing in the well casing.

For fluid flow efficiency in these prior pumping systems, the motor must mount to the housing bottom. Specifically, fluid cannot flow through the motor, so the motor must be located in a position out of the fluid flow path. However, locating the motor at the housing bottom, requires electrical wiring extending along the entire length of the impeller section, to the motor. As space is limited in the well casing, the wiring to the motor limits the diameter of the impeller section. Limiting the diameter of the impeller section accordingly reduces the maximum flow rate of fluid available from the pump.

The mechanism 60 has an integral motor and impeller/pump arrangement. That is, pumped fluid effectively flows through the motor. When the mechanism 60 is placed in a well via the well casing, the drive system 66 can thus be located towards the upper end of the mechanism 60, without impairing fluid flow efficiency. Wiring 84 to the drive system 66 therefore does not need to extend along the entire length of the impeller section. Accordingly, the impeller section effectively has a larger diameter, increasing pumping efficiency. Also, as illustrated, external impellers 72 on the tube 68, urge fluid flow in the space not occupied by the drive system 66, between adjacent magnets 78 that are mounted to the inside of the housing 64.

Moreover, the integral impeller/motor arrangement eliminates the shaft coupling between the motor and impellers in many prior systems. As discussed previously, such coupling arrangements introduce frictional losses, take up space, add weight, and can be costly and subject to mechanical breakdown. The mechanism 60 avoids these drawbacks as it does not employ such a coupling arrangement.

As illustrated, each end of a neck 69 of the tube 68 may extend past its respective end of the housing 64. An extending tube neck 69 can thus be coupled to another device for providing rotational mechanical energy, i.e., for acting as a motor shaft for the other device such as a conventional pump 47, as with the first described embodiment. Thus, the mechanism 60 can be staged with other pumping systems, as with the first described embodiment. Moreover, fluid flow through the drive system 66, results in improved cooling relative to prior electric motors, when using the mechanism 60 as a motor.

Applications are contemplated for the mechanism 60 for use simply as a flow-through motor. That is, the mechanism 60 drives another device, with fluid flowing through the other device and the mechanism, with no need for the mechanism to cause pumping of the fluid. That is, the pumping is caused by the other device, or systems. Accordingly, in this flow-through motor arrangement, the impellers 70 and 72 in the mechanism 60 may be eliminated.

While preferred embodiments of the invention have been illustrated and described, it will be appreciated that various changes can be made therein without departing from the spirit and scope of the invention. For example, the tube 56 of FIG. 2, may have ends that narrow to a neck, as with the tube 68 of FIG. 4. Smaller, and less costly bearings (and seals), could thus be used to rotatably mount the tube, without employing a shaft. When employing such a tube having necks, the housing for the tube could be modified to have a tubular recess extending from one tube neck to the other. Hence, smaller, less costly, annular seals could be employed for protecting the drive system from electrical shorts when pumping a fluid that is conductive.

The previously described embodiments, preferably employ, at least in part, electromagnets, with each electromagnet having a core, for creating interacting magnetic forces. In alternative embodiments, electromagnets without cores may be employed. Also as mentioned above, interacting magnetic forces can also be caused via induction as in a conventional electric induction motor.

In other alternative embodiments, a pneumatic or hydraulic drive system, rather than an electromagnetic drive system may be employed. For instance, in the mechanisms 10 and 44 of FIGS. 3 and 6, the magnets may be replaced with impellers mounted to the exterior of the tube, within the housing's tubular recess. A fluid could then injected into an opening at one end of the tubular recess, and received at another opening. As the fluid passes through the tubular recess, the fluid would act against the tube's external impellers, causing the tube to rotate.

The embodiments described above, preferably employ an integral impeller/pump and drive system arrangement for causing an internal tube to rotate. In yet other alternative embodiments, other systems may be employed for causing the tube to rotate. For example, a motor in the housing for the various embodiments could be used, mounted to one side of the tube, which rotates the tube via gearing, rollers, belts, or other arrangement. While these particular alternative embodiments may have the disadvantage of requiring a coupling mechanism between a tube and a motor, it still provides advantages. By way of non-limiting, illustrative example, such a mechanism would function in general for providing motive force, and in particular for pump system applications.

In view of the alterations, substitutions and modifications that could be made by one of ordinary skill in the art, it is intended that the scope of letters patent granted hereon be limited only by the definitions of the appended claims.

The embodiments of the invention in which an exclusive property or privilege is claimed are defined as follows:

1. A mechanism for providing motive force, the mechanism comprising:

(a) a housing;

(b) a tube having a longitudinal axis, the tube being rotatably mounted within the housing for rotation of the tube relative to the housing, substantially about the longitudinal axis of the tube;

(c) a plurality of magnets mounted within the housing, located around the tube, for creating magnetic forces for causing the tube to rotate relative to the housing and (d) at least one impeller mounted to the tube, the impeller being adapted to cause fluid to flow through the tube when the tube is rotated relative to the housing, wherein the tube includes an inner and an outer circumference, and has at least one impeller mounted around both the inner and outer circumferences of the tube.

2. The mechanism of claim 1, wherein the housing has opposite ends, with one end defining an inlet for receiving a fluid into the housing and into the tube, and the other end defining an outlet for receiving fluid from the tube, and discharging fluid out of the housing.

3. The mechanism of claim 1, wherein the housing includes an exterior wall, and the tube includes opposite ends, with at least one end of the tube extending through the exterior wall of the housing, for connection of the end of the tube to another device.

4. The pumping mechanism of claim 1, further comprising a shaft supporting the tube, wherein the shaft includes an end, with the housing rotatably supporting the shaft for permitting rotation of the tube.

5. The pumping mechanism of claim 1, wherein at least some of the magnets are mounted to the housing.

6. The pumping mechanism of claim 1, wherein at least some of the magnets are electromagnets.

7. A mechanism for providing motive force, the mechanism comprising:

(a) a housing;

(b) a tube having a longitudinal axis, the tube being rotatably mounted within the housing for rotation of the tube relative to the housing, substantially about the longitudinal axis of the tube;

(c) power means for causing rotation of the tube relative to the housing, the power means being connected to the tube; and (d) at least one impeller mounted to the tube, the impeller being adapted to cause fluid to flow through the tube when the tube is rotated relative to the housing, wherein the tube includes both an inner and outer surface, and has at least one impeller mounted to the inner surface of the tube, and at least one impeller mounted to the outer surface of the tube.

8. The mechanism of claim 7, wherein the power means includes a plurality of magnets mounted within the housing for creating magnetic forces for causing rotation of the tube relative to the housing.

9. The pumping mechanism of claim 8, wherein at least some of the magnets are mounted to the tube.

10. The pumping mechanism of claim 8, wherein at least some of the magnets are permanent magnets.

11. The mechanism of claim 7, wherein the housing has opposite ends, with one end defining an inlet for receiving a fluid into the housing and into the tube, and the other end defining an outlet for receiving fluid from the tube, and expelling fluid out of the housing.

12. The mechanism of claim 7, wherein the housing includes an exterior wall, and the tube includes opposite ends, with at least one end of the tube extending through the exterior wall of the housing, for connection of the end of the tube to another device.

13. The mechanism of claim 7, further comprising a shaft supporting the tube, wherein the shaft includes an end, and the housing includes an exterior wall, with the housing rotatably supporting the shaft for permitting rotation of the tube, and with the end of the shaft extending through the exterior wall of the housing for connection to another device.

14. A mechanism for providing motive force, the mechanism comprising:

(a) a housing having an exterior wall;

(b) a tube having a longitudinal axis and opposite ends, the tube being rotatably mounted within the housing for rotation of the tube relative to the housing, substantially about the longitudinal axis of the tube, with at least one end of the tube extending through the exterior wall of the housing for connection to another device; and (c) a drive system mounted within said housing and connected to the tube for causing rotation of the tube relative to the housing.

15. The mechanism of claim 14, wherein the drive system includes a plurality of magnets mounted within the housing, located around the tube, for creating magnetic forces for causing rotation of the tube.

16. The mechanism of claim 15, wherein at least some of the magnets are mounted to the tube.

17. The mechanism of claim 14, further comprising at least one impeller mounted to the tube, the impeller being adapted to cause fluid to flow through the tube when the tube is rotated relative to the housing.

18. The mechanism of claim 17, wherein the tube includes both an inner and outer surface, and has at least one impeller mounted to the inner surface of the tube, and at least one impeller mounted to the outer surface of the tube.

19. A mechanism for providing motive force, the mechanism comprising:

(a) a housing having an exterior wall;

(b) a tube having a longitudinal axis and opposite ends, the tube being rotatably mounted within the housing for rotation of the tube relative to the housing, substantially about the longitudinal axis of the tube;

(c) a drive system connected to an outer surface of the tube for causing rotation of the tube relative to the housing; and (d) shaft means connected to the tube, and extending through the exterior wall of the housing, for connection to another device.

20. The mechanism of claim 19, wherein the tube includes opposite ends, and the shaft means includes one end of the tube extending through the exterior wall of the housing for connection to another device.

21. The mechanism of claim 19, wherein the shaft means includes a shaft supporting the tube, with the housing rotatably supporting the shaft for permitting rotation of the tube, and the shaft includes at least one end extending through the exterior wall of the housing for connection to another device.

22. The mechanism of claim 19, further comprising a plurality of magnets mounted within the housing, located around the tube, wherein the magnets create magnetic forces for causing the tube to rotate relative to the housing.

23. The mechanism of claim 22, wherein at least some of the magnets are mounted to the tube.

24. The mechanism of claim 19, further comprising at least one impeller mounted to the tube, the impeller being adapted to cause fluid to flow through the tube when the tube is rotated relative to the housing.

25. The mechanism of claim 24, wherein the tube includes both an inner and outer surface, and has at least one impeller mounted the inner surface of the tube, and at least one impeller mounted to the outer surface of the tube.

* * * * *